US006207759B1

(12) United States Patent
Iwase et al.

(10) Patent No.: US 6,207,759 B1
(45) Date of Patent: Mar. 27, 2001

(54) COMPOSITION FOR A COVER OF A GOLF BALL

(75) Inventors: Yoshiyuki Iwase; Sumio Fujita; Eisaku Hirasawa, all of Ichihara (JP)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 08/933,177

(22) Filed: Sep. 18, 1997

Related U.S. Application Data

(63) Continuation of application No. 08/633,094, filed on Apr. 16, 1996, now abandoned, which is a continuation-in-part of application No. 08/224,619, filed on Apr. 7, 1994, now abandoned.

(30) Foreign Application Priority Data

Apr. 8, 1993 (JP) ..... 5-82128

(51) Int. Cl.[7] ..... A63B 37/12; C08L 33/02

(52) U.S. Cl. ..... 525/221; 525/196; 525/201; 473/378; 473/385

(58) Field of Search ..... 525/196, 201, 525/221; 473/372, 377, 378, 385

(56) References Cited

U.S. PATENT DOCUMENTS

| | | | |
|---|---|---|---|
| 3,365,520 | 1/1968 | Foster | 525/201 |
| 3,789,035 | 1/1974 | Iwami et al. | 525/195 |
| 4,526,375 | 7/1985 | Nakade | 525/221 |
| 4,801,649 | 1/1989 | Statz | 525/221 |
| 4,884,814 | 12/1989 | Sullivan | 525/196 |
| 4,956,414 | 9/1990 | Muehlenbernd et al. | 525/196 |
| 5,209,485 | 5/1993 | Nesbitt . | |
| 5,274,041 | 12/1993 | Yamada | 525/221 |
| 5,281,651 | 1/1994 | Arjunan et al. | 525/196 |
| 5,321,089 | 6/1994 | Cadorniga et al. | 525/196 |
| 5,397,840 | 3/1995 | Sullivan et al. | 525/221 |

FOREIGN PATENT DOCUMENTS

A 2 625 909 7/1989 (FR) .

OTHER PUBLICATIONS

Research Disclosure 27103–Nov. 1986–E.I. du Pont.

Surlyn Product Brochure.

PCT/US94/03898 (AD–6236) International Search Report dated Nov. 3, 1994.

*Primary Examiner*—David Buttner

(57) ABSTRACT

A scale has marks or a point-symmetrical shape which are arranged in matrix. The scale and an article to be measured in dimension are positioned without any relative movement. An image sensor unit detects a predetermined portion of the article and the marks of the scale corresponding to the predetermined portion of the article selectively and successively, and the image sensor unit generates output signals in accordance with the detected results of the article and the scale. The output signals are processed to calculate the dimension of the article.

12 Claims, 1 Drawing Sheet

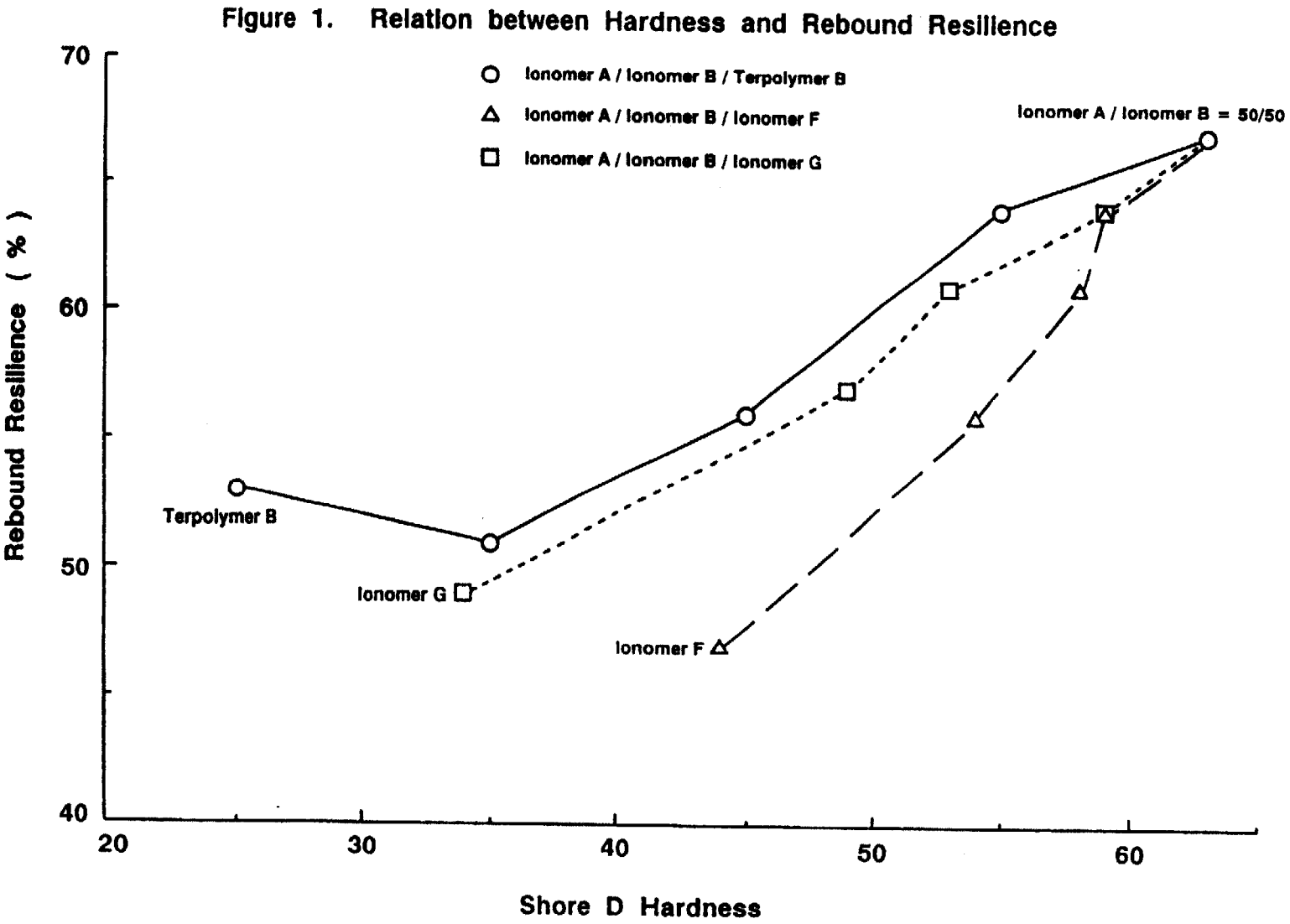
Figure 1. Relation between Hardness and Rebound Resilience

COMPOSITION FOR A COVER OF A GOLF BALL

This is a continuation of application Ser. No. 08/633,094, filed on Apr. 16, 1996 now abandoned which is a division of application Ser. No. 08/224,619 filed Apr. 7, 1994, now abandoned.

FIELD OF THE INVENTION

The invention relates to an apparatus for measuring dimension, angle, distance, size etc. (defined "dimension" simply hereinafter) of an article and a scale to be used in the same, and more particularly to, an apparatus for improving precision in measuring dimension of an article regardless of a portion of the article to be measured and a scale to be used in the same.

BACKGROUND OF THE INVENTION

A conventional apparatus for measuring dimension of an article is described in the Japanese Patent Publication No. 5-85004 published on Dec. 5, 1993. The conventional apparatus for measuring dimension of an article comprises X- and Y-transparent scale plates having marks for scales, a mount plate for placing a rectangular sheet article to be measured thereon, a light equipment for radiating light to the article placed on the transparent scale plates, and X-, Y- and origin image sensors for receiving light transmitted through the X- and Y-transparent scale plates.

In operation, the rectangular sheet article is placed on the mount plate, such that first and second orthogonal sides of the rectangular sheet article are positioned on inner portions of the X- and Y-transparent scale plates, and a vertex defined by the first and second orthogonal sides is positioned on an inner portion of a crossing area of the X- and Y-transparent scale plates. Then, light is radiated from the light equipment to the X- and Y-transparent scale plates, so that light transmitted through outer portions of the X- and Y-transparent scale plates and an outer portion of the crossing area is received by X-, Y- and origin image sensors. In accordance with output signals of the X-, Y- and origin image sensors, a position of the vertex defined by the first and second orthogonal sides of the rectangular sheet article, and positions of two other vertexes defined by the second side and a third side of the rectangular sheet article, and by the first side and a fourth side of the rectangular sheet article are determined relative to the scales of the X- and Y-transparent scale plates. Consequently, lengths of the first to fourth sides of the rectangular sheet article, lengths of diagonal lines of the rectangular sheet article and vertex angles of the rectangular sheet article are obtained in accordance with the calculation of using the positions of the three vertexes of the rectangular sheet article.

In the conventional apparatus for measuring dimension of an article, however, there are disadvantages in that, for instance, a distance between two arbitrary points on the rectangular sheet article is impossible to be measured, because the positions of the vertexes are detected by using the X- and Y-transparent scale plates, and any pattern defined on the rectangular sheet article can not be measured, even if the pattern is positioned in the vicinity of the first and second sides, because each of the X- and Y-image sensors can not discriminate the pattern from the marks for the scales due to the structure in which the rectangular sheet article is positioned directly on the X- and Y-scale plates.

SUMMARY OF THE INVENTION

Accordingly, it is an object of the invention to provide an apparatus for measuring dimension of an article in which a distance between two arbitrary points on an article can be measured, even if the two points are far from, or off sides or edges of the article, and a scale to be used in the same.

It is a further object of the invention to provide an apparatus for measuring dimension of an article in which marks for a scale and a pattern defined on the article are precisely discriminated from the others to increase precision in measuring the dimension of the article, and a scale to be used in the same.

According to the feature of the invention, an apparatus for measuring dimension of an article, comprises:

a table for placing an article to be measured in dimension thereon;

a scale having marks arranged in matrix;

means for commonly moving the table and the scale;

an image sensor unit for selectively detecting a portion of the article and the marks of the scale corresponding to the portion of the article;

means for providing a relative movement between the table and the image sensor unit; and a calculation unit for calculating the dimension of the article in accordance with output signals of the image sensor unit.

According to another feature of the invention, a scale to be used in an apparatus for measuring dimension of an article, comprises:

a scale substrata;

marks arranged in matrix on the scale substrat, each of the marks having a width of W and a height of W, and being arranged by a pitch of $P_1$, and each of the marks being of a point-symmetrical shape, wherein the marks meet conditions as defined below, $$2P_1-W<V,$$

$$W<P_1/2, \text{ and}$$

$$2P_2 \leqq W$$

where V is a view area of an image sensor unit to detect the scale, and $P_2$ is a pitch of matrix-arranged sensors of the image sensor unit.

BRIEF DESCRIPTION OF THE DRAWINGS

The invention will be explained in more detail in conjunction with appended drawings, wherein;

FIGS. 1A to 1H are explanatory diagrams showing an apparatus for measuring dimension of an article in a first preferred embodiment according to the invention, in which FIG. 1A shows the apparatus, FIG. 1B shows a scale used in the apparatus, FIG. 1C shows marks for the scale, FIG. 1D shows an image sensor unit used in the apparatus, FIG. 1E shows an article to be measured in the apparatus, and FIGS. 1F to 1H show the relation of CCD sensors of the image sensor unit to a mark of the scale in the apparatus, and FIGS. 2 to 4 are explanatory diagrams showing apparatuses for measuring dimension of an article in second to fourth preferred embodiments according to the invention.

DESCRIPTION OF THE PREFERRED EMBODIMENTS

An apparatus for measuring dimension of an article in the first preferred embodiment according to the invention will be explained in FIGS. 1A to 1H.

In FIG. 1A, the apparatus comprises an X-table 1*a* moving in the X-direction indicated by an arrow, a Y-table 1*b* moving in the Y-direction orthogonal to the X-direction, on which an article 2 is placed to be measured in dimension, a transparent scale plate 4 provided on the Y-table 1*b* to have a scale on one surface thereof, an image sensor unit 3 having a focusing system (not shown) to be focused on the article 2 and the scale of the scale plate 4 selectively, a calculation unit 5 for calculating dimension of the article 2 by receiving output signals of the image sensor unit 3, and light equipments 7*a*, 7*b* and 7*c* for directing light through the scale plate to the article 2.

In the apparatus, the Y-table 1*b* and the scale plate 4 are designed, such that the article 2 is placed on the Y-table 1*b* to have a distance d greater than a focus depth of the focusing system of the image sensor unit 3 from the scale plate 4.

FIG. 1B shows the tranparent scale plate 4 having marks 41 for the scale arranged in matrix.

In FIG. 1C, the marks 41 which are enlarged are of a width W and a height W, and arrayed by a pitch $P_1$.

FIG. 1D shows a view area V×V on the marks 41 of the scale plate 4 or the article 2 covered by CCD sensors 31 of the image sensor unit 3, wherein the CCD sensors 31 are arranged in matrix by a pitch $P_2$.

FIG. 1E shows the article 2 of, for instance, a metal plate having apertures 21 and 22 formed by a distance D between the central points $O_1$ and $O_2$ thereof.

In FIGS. 1F to 1H, the CCD sensors 31 of the image sensor unit 3 detect the mark 41 of the scale plate 4, so that a detected signal S is supplied to the calculation unit 5, wherein a waveform of the output signal S depends on the relation between the width W of the mark 41 and the pitch $P_1$ of the CCD sensors 31 of the image sensor unit 3, and the relative position of the CCD sensors 31 to the mark 41.

In order to locate a specific one of the marks 41 having the same size and configuration, the conditions must be met as set out below.

$$M<P_1/2 \quad (1)$$

where M is an approximate position precision of the X- and Y-tables 1*a* and 1*b*, even if a scale other than one used in the invention is used.

$$2P_1+W<V, \quad (2)$$

This means that more than two marks 41 must be covered in the X- and Y-directions by the image sensor unit 3.

$$W<P_1/2 \quad (3)$$

This means that a ratio of the pitch $P_1$ to the width W must be less than two, so that the influence of the article 2 to an image of the marks 41, that is the deterioration of resolution is suppressed to be low.

$$2P_2 \leqq W \quad (4)$$

This means that the width W must be larger relative to the pitch $P_2$ of the CCD sensors 31 by a predetermined value, that is, two times. Consequently, the central point of each mark 41 is precisely obtained in accordance with the processing of the output signals S. The relation as shown in FIG. 1G does not meet the above condition to generate the output signal S which is of a pulse-like waveform, while the relations as shown in FIGS. 1F and 1H meet the above condition to provide the output signals S which are of a step-shaped waveform.

The step-shaped waveform is advantageous in processing the output signals S, and discriminating dust on the scale-plate 4 from the marks 41.

In measuring dimension of the article 2, the calculation unit 5 uses the central points of the marks 41. Therefore, the width W of the marks 41 is permissible to have deviation, because the central points thereof are not deviated due to the structure in which the marks 41 are square to be symmetrical in regard to the central points.

In this sense, the marks 41 are not limited to be square, but point-symmetrical shapes such as circle, etc.

As discussed above, one specific optimum example is as follows.

W=80 μm, $P_1$=100 μm, V=1000 μm, M=100 μm, and $P_2$=2 μm,

As described in FIG. 1A, the article 2 is separated on optical axis from the marks 41 of the scale plate 4 by the predetermined distance preferably largely greater than the focus depth.

In one specific example, d=5 to 10 mm, when the focus depth of the focusing system of the image sensor unit 3 is 14 μm.

In operation, the X- and Y-tables 1*a* and 1*b* are controlled successively to move in the X- and Y-directions, respectively, so that the aperture 21 of the article 2 is positioned below the image sensor unit 3. At this state, the aperture 21 and the marks 41 of the scale plate 4 covering the aperture 21 are focused separately by the focusing system of the image sensor unit 3. Thus, the aperture 21 and the marks 41 are detected separately by the CCD sensors 31 of the image sensor unit 3, so that output signals S are supplied therefrom to the calculation unit 5, in which the central point $O_1$ of the aperture 21 is calculated in accordance with addresses of the marks 41. Then, the X- and Y-tables 1*a* and 1*b* are moved in the X- and Y-directions, respectively, so that the aperture 22 of the article 2 is positioned below the image sensor unit 3. In the same manner as in the aperture 21, the central point $O_2$ of the aperture 22 is calculated in accordance with addresses of the marks 41 in the calculation unit 5.

Then, the distance D between the central points $O_1$ and $O_2$ of the apertures 21 and 22 is calculated in accordance with the calculated positions thereof in the calculation unit 5.

In an apparatus for measuring dimension of an article in the invention, an image sensor unit 3 may be moved in the X- and Y-directions, while an article 2 and a scale may be stationary, and a magnetical detecting system may be adopted in place of the optical detecting system as adopted above.

FIG. 2 shows an apparatus for measuring dimension of an article in the second preferred embodiment according to the invention, wherein like parts are indicated by like reference numerals as used in the first preferred embodiment, provided that the scale plate 4 having the marks for the scale is provided on the opposite side to the article 2.

In the apparatus, the X- and Y-tables are simply shown by a table 1, and the image sensor unit 3 as shown in FIG. 1A is replaced by image sensor units 3A and 3B which are provided at the same positions on the opposite sides relative to the table 1.

In operation, the article 2 and the scale plate 4 are moved to take the same positions relative to the image sensor units 3A and 3B in accordance with the X- and Y-movements of the table 1. Thus, output signals of the image sensor units 3A and 3B are supplied to the calculation unit 5, in which the output signals are processed to calculate dimension of the article 2.

FIG. 3 shows an apparatus for measuring dimension of an article in the third preferred embodiment according to the invention, wherein like parts are indicated by like reference numerals as used in the first and second preferred embodiments.

In the apparatus, the scale plate 4 has the scale 4A on the surface facing the article 2 to increase precision in measuring dimension of the article 2 for the reason why both the article 2 and the scale 4A are detected through the scale plate 4 by the image sensor unit 3, so that the influence of a refractive index of the scale plate 4 is commonly applied to the detecting lights of the article 2 and the scale 4A.

FIG. 4 shows an apparatus for measuring dimension of an article in the fourth preferred embodiment according to the invention, wherein like parts are indicated by like reference numerals as used in the first to third preferred embodiments.

In the apparatus, a half mirror 6 is provided at an angle of 45° relative to the X- and Y-table 1 and the scale table 4 having the scale 4A, and shutters 8A and 8B are provided to shut one of light paths for the scale 4A and the article 2. The shutters 8A and 8B may be omitted when other means such as using different wavelengths of lights for the scale 4A and the article 2 is adopted.

In operation, a predetermined portion of the article 2 and the relevant marks of the scale 4A are selectively detected in accordance with the switch-over of the shutters 8A and 8B by the image sensor unit 3.

In the second and fourth preferred embodiments, optical distances can be equal to decrease error.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A scale to be used in an apparatus for measuring dimension of an article, comprising:

a scale substrate;

marks arranged in a matrix on said scale substrate, each of said marks having a width of W and a height of W, and being arranged by a pitch of $P_1$, and each of said marks being of a point-symmetrical shape, wherein said marks meets conditions as defined below, $$2P_1+W<V,$$

$$W<P_1/2, \text{ and}$$

$$2P_2 \leqq W$$

where V is a length of a side of a view area of an image sensor unit for detecting said scale, and $P_2$ is a pitch of matrix-arranged sensors of the image sensor unit.

2. The scale of claim 1 wherein said marks are square.

3. The scale of claim 1 wherein said marks are round.

4. The scale of claim 1 wherein said substrate is transparent.

5. A combination scale and image sensor unit for an apparatus for measuring a dimension of an article, said scale comprising a substrate with a first matrix of symmetrically shaped marks thereon which are arranged in the first matrix with pitch P1, each of the marks having a corresponding internal distance which is approximately W;

said image sensor unit for detecting said marks on said scale in a view area with a side of length V and comprising plural sensors arranged in a second matrix with a pitch P2; and wherein, $$2P_1+W<V,$$

$$W<P_1/2, \text{ and}$$

$$2P_2 \leqq W.$$

6. The combination of claim 5 wherein each of said plural sensors comprises a CCD sensor.

7. The combination of claim 5 wherein said marks are square and W is the length of a side thereof.

8. The combination of claim 5 wherein said marks are round and W is the diameter thereof.

9. The combination of claim 5 wherein said substrate is transparent.

10. The combination of claim 5 wherein said view area is square.

11. The combination of claim 5 wherein said image sensor unit is further for providing an output signal with a step-shaped waveform related to each detected one of said marks so that a central point of each of the detected said marks can be identified.

12. The combination of claim 11 further comprising a calculation unit for receiving said output signal and for comparing a first received said output signal to a second received said output signal to measure a dimension related to said first and second output signals.

* * * * *

UNITED STATES PATENT AND TRADEMARK OFFICE

CERTIFICATE OF CORRECTION

PATENT NO. : 6,207,759 B1
DATED : March 27, 2001
INVENTOR(S) : Iwase et al.

It is certified that error appears in the above-identified patent and that said Letters Patent is hereby corrected as shown below:

Replace the published abstract with the following corrected version.

(57) ABSTRACT

A composition for a golf ball cover material which comprises (A) 30 to 70 parts by weight of metal salts of an ethylene/ethylenically unsaturated monocarboxylic acid copolymer having an ethylenically unsaturated monocarboxylic acid content of 10 to 30 percent by weight and a degree of neutralization of at least 25 mole percent and (B) 70 to 30 parts by weight of an ethylene/(meth)acrylate ester/ethylenically unsaturated monocarboxylic acid terpolymer having a (meth)acrylate ester content of 12 to 45 percent by weight and an ethylenically unsaturated monocarboxylic acid content of 0.5 to 5% by weight.

Delete Columns 1-8 and substitute therefore Columns 1-8, as shown on attached pages.

Signed and Sealed this

Twenty-fifth Day of December, 2001

*Attest:*

*Attesting Officer*

JAMES E. ROGAN
*Director of the United States Patent and Trademark Office*

COMPOSITION FOR A COVER OF A GOLF BALL

This is a continuation of application Ser. No. 08/633,094 filed Apr. 16, 1996, now abandoned, which is a continuation-in-part of prior application Ser. No. 08/224,619, filed Apr. 7, 1994, and entitled Composition for a Cover of a Golf Ball, now abandoned.

BACKGROUND OF THE INVENTION

1. Field of the Invention

This invention relates to a composition for a cover of a golf ball. More specifically, it relates to a composition for a cover material of a golf ball suitable for the production of golf balls which are easy to control, and have excellent softness and rebound resilience.

2. Prior Art and its Problems

Golf balls having balata as a cover material have advantages that they have an excellent feel when struck by a golf club and are easy to control. They are especially preferred by the more skilled golfers, but have the defect that they have poor durability. The art teaches golf balls having improved cut resistance and having similar advantages to balata covered golf balls can be made by using a blend of a hard ionomer and a soft ionomer as a cover material (Research Disclosure 27103 (November 1987), Japanese Laid-Open patent Publication No. 308577/1989, and Japanese Laid-Open Patent Publication No. 3931/1993).

This art relates to blends of ionomers. What has been specifically considered have a somewhat higher hardness than balata. Cover materials having the same hardness as balata or having a hardness less than that of balata are desired. Also, higher rebound resilience with low hardness is desired.

The present invention obtains a golf ball cover material having a high rebound resilience but a low hardness. The inventors have found that golf balls having a cover material made by compounding (A) and (B) components as defined below in a predetermined ratio has the desired properties. It is possible to design quality in a wide range in a balance of hardness and rebound resilience.

SUMMARY OF INVENTION

According to this invention, a composition which comprises, 20 to 80 parts by weight of component (A) and 80 to 20 parts by weight of component (B) is used as a cover material of a golf ball. Component (A) comprises metal salts of an ethylene/ethylenically unsaturated monocarboxylic acid copolymer having an ethylenically unsaturated monocarboxylic acid content of 10 to 30% by weight and a degree of neutralization of at least 25 mole %. Component (B) comprises an ethylene/(meth) acrylate ester/ethylenically unsaturated monocarboxylic acid terpolymer having a (meth) acrylate ester content of 12 to 45% by weight and an ethylenically unsaturated monocarboxylic acid content of 0.5 to 5% by weight.

In the present invention, by compounding a specified component (B), that is, an ethylene/(meth) acrylate ester/unsaturated monocarboxylic acid terpolymer having a (meth) acrylate ester content of 12 to 45% by weight and an unsaturated monocarboxylic acid content of 0.5 to 5% by weight, with a specified component (A), that is, an ionomer having a degree of neutralization of at least 25 mole % of an ethylene/unsaturated monocarboxylic acid copolymer having an unsaturated monocarboxylic acid content of 10 to 30% by weight, softness can be imparted to the cover of a golf ball without significant reductions in rebound resilience.

By avoiding the use of an ionomer as component (B) as is provided in the art and by substituting the component (B) of the present invention, the golf ball obtained has excellent economy. Also, by doing so, the defects of decreased resilience and sacrifice of carrying distance experienced when the soft golf ball cover material is composed of two ionomer components are overcome without losing the advantageous controllability of a ball and a feeling when hit with a golf club.

In the present invention, by selecting component (B), the ethylene/(meth)acrylate ester/unsaturated monocarboxylic acid terpolymer, and compounding it with component (A), the copolymer ionomer, we have succeeded in increasing softness without significantly decreasing rebound resilience. That is to say, a golf ball with the cover made using the composition of this invention has good controllability, good feel and excellent ball carrying distance when hit with a golf club.

BRIEF DESCRIPTION OF FIGURE

FIG. 1 is a plot of the data in Table 4 showing higher resilience at same hardness with present invention.

PREFERRED EMBODIMENTS OF THE INVENTION

Component (A), the metal salts of the ethylene/unsaturated monocarboxylic acid copolymer, has an unsaturated monocarboxylic acid content of 10 to 30% by weight, preferably 13 to 25% by weight, and is an ionomer which is neutralized with metal cations so that the degree of neutralization of the ethylene/unsaturated monocarboxylic acid copolymer is at least 25 mole %, preferably 30 to 80 mole %. The unsaturated monocarboxylic acids preferable include aliphatic monocarboxylic acids with 3 to 8 carbon atoms. Acrylic acid and methacrylic acid are especially preferred.

Copolymers having an unsaturated monocarboxylic acid content smaller than the above-mentioned range are not preferred because the resulting compositions have lower rebound resilience. Furthermore, when copolymers having an unsaturated monocarboxylic acid content exceeding 30% by weight are used, moisture absorption becomes higher and it is not preferred.

Component (A) can comprise blends of two or more copolymers. The degree of neutralization in this case may be adjusted so that the degree of neutralization of the blend as a whole becomes at least 25 mole %.

Examples of metal cation species in the ionomer include monovalent metal cations such as lithium, sodium, and potassium, and divalent metals such as magnesium, calcium and zinc. The ionomers may be only one kind of metal salts, but preferably, the metal salts may be a mixture containing at least one kind of monovalent metal cation and at least one kind of the divalent metal cation. The ratio of the monovalent metal salts to the divalent metal salts may be in the range of 9:1 to 1:9, preferably 7:3 to 3:7 in weight.

Degree of neutralization in the ionomer of less than 25 mole % is not preferred because the resulting composition would not have good rebound resilience and cutting resistance.

The copolymer which is partially neutralized to form component (A) may be produced by copolymerizing ethylene with the unsaturated monocarboxylic acid at a high temperature under a high pressure using a radical initiator. This production method is already well known.

Component (A) ionomer preferably has a melt flow rate of 0.1 to 30 g/10 minutes, especially 0.5 to 15 g/10 minutes, at 190° C. under a load of 2160 g. Preferably, it has a Shore D hardness of 50 to 80, especially 55 to 75.

Component (B), the ethylene/(meth)acrylate ester/unsaturated monocarboxylic acid terpolymer used in this invention, has a (meth) acrylate ester content of 12 to 45% by weight, preferably 15 to 40% by weight, and an unsaturated monocarboxylic acid content of 0.5 to 5% by weight, preferably 1 to 4.5% by weight. By (meth) acrylate ester, it is meant an acrylate ester and or a methacrylate ester. Specific examples include ester groups having alkyl groups of 4 to 12 carbon atoms such as methyl acrylate, ethyl acrylate, isobutyl acrylate, n-butyl acrylate, 2-ethyl hexyl acrylate, methyl methacrylate, and isobutyl methacrylate.

Typical examples of the unsaturated monocarboxylic acid in component (B) terpolymer include those having about 3 to 10 carbon atoms, for example acrylic acid, methacrylic acid, and monoalkyl esters of dicarboxylic acids such as monomethyl maleate, monoethyl maleate, and monoisobutyl maleate. Among these, it is preferred to select monoalkyl esters of dicarboxylic acids.

Component (B) terpolymers can be obtained by copolymerizing the respective monomers at a high temperature under high pressure using a radical initiator. This production method is widely known.

If component (B) terpolymer has a (meth) acrylate ester content lower than the above-mentioned range, it is difficult to obtain a fully soft composition. Furthermore, when a component (B) terpolymer has a (meth) acrylate ester content higher than the above-mentioned range, the compositions becomes too soft, and unpreferably the cutting resistance becomes poor.

If component (B) terpolymer has an unsaturated monocarboxylic acid content lower than the above-mentioned range, its compatibility with component (A) becomes poor, and unpreferably the cutting resistance becomes poorer. Furthermore, when component (B) terpolymer has an unsaturated monocarboxylic acid content higher than the above-mentioned range, unpreferably the rebound resilience becomes poor.

Preferably, the component (B) terpolymer has a melt flow rate of 0.1 to 30 g/10 minutes at 190° C. under a load of 2160 g, especially 0.3 to 20 g/10 minutes, and a Shore D hardness of not more than 45, especially 10 to 35.

Typical examples of preferred component (B) terpolymers include ethylene/acrylic acid/methyl acrylate terpolymer, ethylene/acrylic acid/isobutyl acrylate terpolymer, and ethylene/methacrylic acid/isobutyl acrylate terpolymer, and ethylene/methacrylic acid/n-butyl acrylate terpolymer, ethylene/methyl acrylate/monomethyl maleate random terpolymer, ethylene/methyl acrylate/monomethyl/maleate random terpolymer, ethylene/methyl acrylate/monoethyl maleate random terpolymer, and ethylene/methyl methacrylate/monomethyl maleate random terpolymer. Component (B) may be a blend of two or more components.

The ratio of the component (A) metal salts of an ethylene/unsaturated monocarboxylic acid copolymer to the component (B) terpolymer is 20 to 80 parts by weight, preferably 30 to 70 parts by weight, to 80 to 20 parts by weight, preferably 70 to 30 parts by weight. When the unsaturated monocarboxylic acid in the terpolymer is an unsubstituted monocarboxylic acid, preferably component (A) is 50 to 80 parts by weight, more preferably 55 to 70 parts by weight, and the amount of component (B) is 50 to 20 parts by weight, especially 45 to 30 parts by weight. By compounding component (A) with component (B) in such proportions, a composition having excellent softness and rebound resilience can be obtained.

Other polymers may be compounded in the composition of this invention within small ranges which do not impair the objects of the present invention. Various additives usually compounded into golf ball cover material may be added. Examples of such additives are various coloring agents, inorganic fillers, antioxidants, and weather resistance stabilizers. Typical additives may include pigments such as titanium oxide, zinc oxide, barium sulfate and zinc sulfate, various dyes, and colors.

The composition of this invention (containing no additives) preferably has a Shore D hardness of 30 to 60, especially 32 to 58, a stiffness of 40 to 200 MPa, especially 45 to 190 MPa, and a rebound resilience of at least 52, especially at least 54.

The resin composition of this invention may be used as a cover material of a three-piece golf ball and a two-piece golf ball.

The three-piece golf ball consists of a center, a rubber thread wound up on the center and a cover on it. The cover material of this invention may be molded onto the thread-wound center of a three-piece ball employing techniques known in the art, particularly compression molding half shells over the thread-wound center. Various dimple patterns can be molded into the cover.

The two piece golf ball consists of a core and a cover thereon. The cover material of this invention may be molded onto the core of a two-piece ball employing techniques known in the art, particularly injection molding the cover material onto the core supported on retractable pins in a cavity of an injection mold to form a two-piece golf ball. Various dimple patterns can be molded into the cover.

EXAMPLES

The present invention will be illustrated by the following examples. The compositions used in the examples are as shown in Table 1.

TABLE I

| | Composition | Melt Flow MFR (g/10 min) | Hardness Shore D (23° C.) | Rebound Resilience (%) |
|---|---|---|---|---|
| Ionomer A | 30 mole % sodium neutralized ethylene/methacrylic acid (85/15 wt. %) copolymer | 2.8 | 61 | 63 |
| Ionomer B | 60 mole % zinc neutralized ethylene/methacrylic acid (85/15 wt. %) copolymer | 0.7 | 60 | 57 |
| Ionomer C | 60 mole % sodium neutralized ethylene/methacrylic acid (80/20 wt. %) copolymer | 1.0 | 67 | 68 |
| Ionomer D | 52 mole % lithium neutralized ethylene/methacrylic acid (85/15 wt. %) copolymer | 1.0 | 63 | 67 |

TABLE I-continued

| | Composition | Melt Flow MFR (g/10 min) | Hardness Shore D (23° C.) | Rebound Resilience (%) |
|---|---|---|---|---|
| Ionomer E | 54 mole % magnesium neutralized ethylene/ methacrylic acid (85/15 wt. %) copolymer | 0.7 | 62 | 64 |
| Ionomer F | 50 mole % sodium neutralized ethylene/ methacrylic acid/n-butyl acrylate (73/10/17) | 1.0 | 44 | 47 |
| Ionomer G | 50 mole % sodium neutralized ethylene/ methacrylic acid/n-butyl acrylate (66/10/24) | 1.0 | 34 | 49 |
| Ionomer H | 70 mole % sodium neutralized ethylene/ methacrylic acid/ isobutyl acrylate (72/8/20 wt %) terpolymer | 1.0 | 41 | 56 |
| Terpolymer A | Ethylene/methyl acrylate/monoethyl maleate (74.7/23/2.3 wt %) terpolymer | 3.6 | 19 | 60 |
| Terpolymer B | Ethylene/ methacrylic acid/ isobutyl acrylate (74/2/24 wt %) terpolymer | 5.0 | 25 | 53 |
| Terpolymer C | Ethylene/ methacrylic acid/ isobutyl acrylate (76/4/20 wt %) terpolymer | 12.0 | 30 | 45 |
| Terpolymer D | Ethylene/ methacrylic acid/ isobutyl acrylate (72/8/20 wt %) terpolymer | 25.0 | 25 | 43 |
| Terpolymer E | Ethylene/ methacrylic acid/ isobutyl acrylate (85/5/10 wt %) terpolymer | 10.0 | 40 | 36 |

Test Methods

The methods of testing the resin compositions and the starting materials were as follows:

1. Melt Flow Rate (MFR)

Using a tester made by Toyo Seiki Seisakusho, MFR was measured at a temperature of 190° C. under a load of 2160 g.

2. Hardness

It was measured by using a Shore D hardness tester (made by Zwick GmbH & Co.) at 23° C. (ASTM D2240).

3. Stiffness

Using a Tinious Olsen-type stiffness measuring machine made by Toyo Seiki Seisakusho, it was measured at 23° C. (ASTM D747).

4. Rebound Resilience

Using a rebound resilience tester (pendulum-type) made by Ueshima Seisakusho Co., Ltd. it was measured at 23° C.

REFERENCE EXAMPLE 1

The ethylene ionomers A and B (50 to 50 parts by weight) were melt-blended at a resin temperature of 200° C. with an extruding amount of 4.0 kg/hr in the compounding ratios shown in Table 2 by using a 30 mm-diameter biaxial extruder (made by Ikegai Tekko Co., Ltd.). The properties of the obtained resin compositions were evaluated. The results are shown in Table 2. The results show that rebound resilience was high, but the composition had high hardness and poor softness.

EXAMPLES 1 TO 10 AND COMPARATIVE EXAMPLES 1 to 7

Reference Example 1 was repeated, except that the starting materials shown in Table 1 were compounded in the proportions shown in Tables 2, 3, and 4. The results are shown in Tables 2, 3, and 4.

Comparative Examples 1 and 2 showed high rebound resilience, but too low stiffness. Hence, when they were used as a golf ball cover, they are liable to be scratched, and therefore are unsuitable.

Comparative Example 3 had too low in hardness and stiffness, and low rebound resilience. Comparative Examples 4 and 5 had suitable hardness, but since they had too low in rebound resilience, they are unsuitable as a golf ball.

In contrast, the compositions obtained in the Examples had suitable hardness, and high rebound resilience.

EFFECT OF THE INVENTION

According to this invention, there can be provided a composition for a golf ball cover material, which has excellent softness and rebound resilience. When such a composition is used as a cover material of a two-piece ball or a three-piece ball, there is provided a golf ball having excellent ball controllability, an excellent feeling, and excellent carrying distance when hit. The unexpected performance made possible by the present invention can be easily seen in Table 4 and FIG. 1, which show that higher rebound resilience for the same hardness is achieved when the terpolymer formulations of the present invention are substituted for the terpolymer ionomers of the prior art.

TABLE 2

| | Experiment No. | | | | | | | | | |
|---|---|---|---|---|---|---|---|---|---|---|
| Compounded Composition | Ref. Ex 1 | Ex 1 | Ex 2 | Ex 3 | Ex 4 | Ex 5 | Ex 6 | Ex 7 | Ex 8 | Ex 9 |
| Ionomer A | 50 | 25 | 15 | 35 | 30 | 25 | 35 | | 25 | |
| Ionomer B | 50 | 25 | 15 | 35 | 30 | 25 | 35 | | 25 | 25 |
| Ionomer C | | | | | | | | | | 25 |
| Ionomer D | | | | | | | | 30 | | |
| Ionomer E | | | | | | | | 30 | | |
| Terpolymer A | | 50 | 70 | 30 | | | | | | |
| Terpolymer B | | | | | 40 | 50 | 30 | 40 | | 50 |
| Terpolymer C | | | | | | | | | 50 | |

TABLE 2-continued

| Compounded Composition | Experiment No. Ref. Ex 1 | Ex 1 | Ex 2 | Ex 3 | Ex 4 | Ex 5 | Ex 6 | Ex 7 | Ex 8 | Ex 9 |
|---|---|---|---|---|---|---|---|---|---|---|
| Properties | | | | | | | | | | |
| MFR (g/10 minutes) | 1.7 | 1.7 | 1.7 | 1.5 | 2.7 | 3.2 | 2.4 | 2.7 | 5.3 | 1.8 |
| Hardness (Shore D) | 63 | 41 | 33 | 55 | 52 | 44 | 54 | 50 | 47 | 50 |
| Stiffness (MPa) | 340 | 78 | 34 | 174 | 155 | 107 | 188 | 152 | 100 | 124 |
| Rebound Resilience (%) | 66 | 60 | 60 | 65 | 60 | 55 | 64 | 59 | 54 | 57 |

TABLE 3

| Compounded Composition | Experiment No. Comp Exam 1 | Comp Exam 2 | Comp Exam 3 | Comp Exam 4 | Comp Exam 5 |
|---|---|---|---|---|---|
| Ionomer A | | | | 25 | 25 |
| Ionomer B | | | | 25 | 25 |
| Terpolymer A | | 100 | | | |
| Terpolymer B | | | | | |
| Terpolymer D | | | 100 | 50 | |
| Terpolymer E | | | | | 50 |
| Ionomer H | 100 | | | | |
| Properties | | | | | |
| MFR (g/10 minutes) | 1.0 | 3.6 | 25.0 | 10.0 | 4.3 |
| Hardness (Shore D) | 41 | 19 | 25 | 46 | 53 |
| Stiffness (MPa) | 34 | 9 | 16 | 87 | 157 |
| Rebound resilience (%) | 56 | 60 | 43 | 48 | 49 |

TABLE 4

| Composition (wt %) | Hardness Shore D | Rebound Resilience (%) |
|---|---|---|
| Ionomer A/Ionomer B - 50/50 (Ref, Ex 1) | 63 | 66 |
| EXAMPLE 10 | | |
| Ionomer A/Ionomer B/Terpolymer B - 35/35/30 | 55 | 64 |
| Ionomer A/Ionomer B/Terpolymer B = 25/25/50 | 45 | 56 |
| Ionomer A/Ionomer B/Terpolymer B = 15/15/70 | 35 | 51 |
| COMP. EXAMPLE 6 | | |
| Ionomer A/Ionomer B/Ionomer F = 35/35/30 | 59 | 64 |
| Ionomer A/Ionomer B/Ionomer F = 25/25/50 | 58 | 61 |
| Ionomer A/Ionomer B/Ionomer F = 15/15/70 | 54 | 56 |
| COMP. EXAMPLE 7 | | |
| Ionomer A/Ionomer B/Ionomer G = 35/35/30 | 59 | 64 |
| Ionomer A/Ionomer B/Ionomer G = 25/25/50 | 53 | 61 |
| Ionomer A/Ionomer B/Ionomer G = 15/15/70 | 49 | 57 |

What is claimed is:

1. A composition for a golf ball cover material which consists essentially of (A) 30 to 70 parts by weight of metal salts of an ethylene/ethylenically unsaturated monocarboxylic acid copolymer having an ethylenically unsaturated monocarboxylic acid content of 10 to 30 percent by weight and a degree of neutralization of at least 25 mole percent and (B) 70 to 30 parts by weight of an ethylene/(meth)acrylate ester/ethylenically unsaturated monocarboxylic acid terpolymer having a (meth)acrylate ester content of 12 to 45 percent by weight and an ethylenically unsaturated monocarboxylic acid content of 0.05 to 5% by weight.

2. The composition according to claim 1 wherein the ethylenically unsaturated monocarboxylic acid in the terpolymer (B) is selected from the group consisting of acrylic acid, methacrylic acid and monoalkyl esters of maleic acid.

3. The composition according to claim 1 wherein the metal salts of the ethylene/ethylenically unsaturated monocarboxylic acid copolymer (A) is a mixture of monovalent metal salts and divalent metal salts.

4. The composition according to claim 3 wherein the ratio of the monovalent to divalent metal salts is in the range of 7:3 to 3:7 in weight.

5. The composition according to claim 1, wherein the metal salts of the ethylene/ethylenically unsaturated monocarboxylic acid copolymer has a melt flow rate of 0.5 to 15 g/10 minutes at 190° C. under a load of 2160 g and a Shore D hardness of 55 to 75.

6. The composition according to claim 1 wherein the terpolymer (B) has a melt flow rate of 0.3 to 20 g/10 minutes at 190° C. under a load of 2160 g and a Shore D hardness of 10 to 35.

7. A golf ball having a core and a cover wherein the cover material consists essentially of (A) 30 to 70 parts by weight of metal salts of an ethylene/ethylenically unsaturated monocarboxylic acid copolymer having an ethylenically unsaturated monocarboxylic acid content of 10 to 30 percent by weight and a degree of neutralization of at least 25 mole percent and (B) 70 to 30 parts by weight of an ethylene/(meth)acrylate ester/ethylenically unsaturated monocarboxylic acid terpolymer having a (meth)acrylate ester content of 12 to 45 percent by weight and an ethylenically unsaturated monocarboxylic acid content of 0.05 to 5% by weight.

8. The golf ball of claim 7 wherein the ethylenically unsaturated monocarboxylic acid in the terpolymer (B) is selected from the group consisting of acrylic acid, methacrylic acid and monoalkyl esters of maleic acid.

9. The golf ball of claim 7 wherein the metal salts of the ethylene/ethylenically unsaturated monocarboxylic acid copolymer (A) are a mixture of monovalent metal salts and divalent metal salts.

10. The golf ball of claim 9 wherein the ratio of the monovalent to divalent metal salts is in the range of 7:3 to 3:7 in weight.

11. The golf ball of claim 7 wherein the metal salts of the ethylene/ethylenically unsaturated monocarboxylic acid copolymer have a melt flow rate of 0.5 to 15 g/10 minutes at 190° C. under a load of 2160 g and a Shore D hardness of 55 to 75.

12. The golf ball of claim 7 wherein the terpolymer (B) has a melt flow rate of 0.3 to 20 g/10 minutes at 190° C. under a load of 2160 g and a Shore D hardness of 10 to 35.

* * * * *